United States Patent [19]

Weeks

[11] Patent Number: 4,726,420

[45] Date of Patent: Feb. 23, 1988

[54] OIL WELL PUMPING SYSTEM

[75] Inventor: Benjamin R. Weeks, Corpus Christi, Tex.

[73] Assignee: Petro-Lift Development Corp., Corpus Christi, Tex.

[21] Appl. No.: 833,246

[22] Filed: Feb. 27, 1986

[51] Int. Cl.[4] ..... E21B 43/00; F04F 5/02

[52] U.S. Cl. ..... 166/68; 166/267; 166/372; 417/172

[58] Field of Search ..... 166/325, 369, 372, 68, 166/267; 417/172

[56] References Cited

U.S. PATENT DOCUMENTS

| | | | |
|---|---|---|---|
| 1,939,124 | 12/1933 | Looman | 417/172 X |
| 2,029,457 | 2/1936 | Beardmore | 417/172 X |
| 3,653,717 | 4/1976 | Rich et al. | 166/372 X |
| 3,980,138 | 9/1976 | Knopik | 166/372 X |
| 4,603,735 | 8/1986 | Black | 166/372 X |
| 4,605,069 | 8/1986 | McClaflin et al. | 166/372 X |

*Primary Examiner*—George A. Suchfield
*Attorney, Agent, or Firm*—G. Turner Moller

[57] ABSTRACT

An oil well is pumped with a jet pump using, as the power fluid, field salt water preferably from the same formation that the well is completed in. The jet pump comprises a series of metallic cylindrical components that are clamped together in a housing connected to the bottom of the tubing string. A tail pipe assembly extends below the bottom of the producing formation to lower the liquid level in the well as low as possible. A more sophisticated tail pipe assembly operates to reduce back pressure on the formation as much as possible.

7 Claims, 4 Drawing Figures

OIL WELL PUMPING SYSTEM

This invention relates to a system for pumping oil and other formation liquids from a well and, more particularly to a well pumping system incorporating an ejector or venturi.

The standard oil well pumping system incorporates a down hole pump, a sucker rod string extending from the down hole pump to the surface and a pump jack at the surface attached to the upper end of the sucker rod string for reciprocating the sucker rods thereby activating the down hole pump. This system has worked well for most applications for many years and has become the standard of the oil field. There are, however, a number of situations where this system has substantial disadvantages. Standards sucker rod installations do not work well, in a technical sense, where the formation produces a large quantity of sand or where the amount of produced formation liquid is very large. There are no real good solutions for pumping wells which make a large quantity of sand. In high volume situations, powered down hole pumps, like Reda or Kobe brand pumps, or gas lift installations have proved economic.

Standard sucker rod installations do not work well, in an economic sense, where the amount of formation liquid is very small because the standard pump jack is so expensive. In a normal pumping well situation, the longevity of the well and the maintenance requirements of the pump jack are such that it makes perfect sense to expend considerable capital to design and manufacture pump jacks of exquisite construction having long lives and low maintenance costs. This does not make sense, of course, in very low volume wells because they may not be able to stand the costs of the pump jacks.

There have been many proposals suggesting pumping arrangements other that conventional pump jack—sucker rod installations. It is a tribute to the engineering efforts spent on conventional pump jacks, sucker rods and down hole pumps that these proposals, with several exceptions, have not been accepted to any appreciable extent.

One class of unorthodox oil well pumping arrangements that has been proposed is a down hole ejector or venturi which is operated by delivering compressed air or natural gas down the annulus to the venturi. The compressed gas passes into the venturi power inlet while formation fluids pass into the venturi suction. A mixture of compressed gas and formation fluid is delivered upwardly through the outlet of the venturi into the bottom of the tubing string, typically past a standing valve. Disclosures of this general type are found in U.S. Pat. Nos. 1,604,644 and 1,757,381. A modification of this theme is found in U.S. Pat. Nos. 1,355,606 and 1,758,376 where a liquid is used as the power fluid. Also of some interest are the disclosures in U.S. Pat. Nos. 1,150,473; 2,287,076; 2,826,994; 3,215,087; 3,887,008; 4,183,722; 4,293,283 and 4,390,061.

It is this type pump which this invention most nearly relates. It has been discovered that technically adequate jet or ejector type pumps can be operated with clean field salt water, by which is meant formation water and preferably water produced from the same formation from which oil is being pumped, after removing the oil and any sediment. Such salt water is readily available and manifestly of little cost. Thus, there are substantial cost advantages of using field salt water. It turns out that using ordinary fresh water is very disadvantageous for several reasons. Fresh water from a shallow water well or otherwise of a quality which may be used to drill a well is sometimes not readily available at low cost. There are areas of petroleum producing areas where fresh water is deemed by ranchers to be as valuable as oil, particularly where one tries to buy some from a livestock tank. In addition, fresh water and oil quite easily make emulsions which are very tough and expensive to break. Thus, pumping a well with a jet pump using reasonably fresh water will produce an emulsion which is quite costly to treat before the oil can be sold.

The jet or ejector pump of this invention comprises a sleeve or housing threadably connected to the lower end of a tubing string extending into the well to a location slightly above the producing formation. In accordance with one embodiment of the invention, a plurality of cylindrical parts are clamped together inside the housing by the end fittings or couplings. Oddly, most of the cylindrical parts are not connected to the housing nor connected to each other. It turns out that only three of the cylindrical parts are unsymmetrical and must be oriented relative to one another. The remaining cylindrical parts are symmetrical and accordingly require no orientation.

A standing or check valve is located below the pump of this invention to hold, in the tubing string, any formation liquid pumped upwardly in the event that pumping of motive liquid down the annulus stops for any reason.

An important feature of this invention is the provision of a tailpipe connected to the inlet of the pump and extending downwardly into the well below the top of the perforations which extend into the productive formation. By positioning the tailpipe as low as possible, the hydrostatic head which must be bucked by the producing formation is minimized as much as possible.

An important variation of the tailpipe concept of this invention is that a plurality of tailpipes may extend downwardly from the bottom of the pump inlet to different levels. For example, assume that one tailpipe terminates in an open lower end ten feet below the bottom of the pump inlet and a second tailpipe terminates in an open lower end 25 feet below the bottom of the pump inlet. Pumping of liquid continues even after the liquid level in the well has been lowered below the bottom of the first tailpipe because liquid can continue to move upwardly in the second tailpipe. Of course, gas flow in the first tailpipe continues whereupon a vacuum is drawn across the face of the formation, thereby promoting additional entry into the well bore from the formation.

It is accordingly an object of this invention to provide an improved technique for pumping liquids from a productive subterranean formation by using field salt water as the motive fluid.

Another object of this invention is to provide an improved down hole jet pump for pumping formation liquids to the surface.

Other objects and advantages of this invention will become more fully apparent as this description proceeds, reference being made to the accompanying drawings and appended claims.

Figure 1:
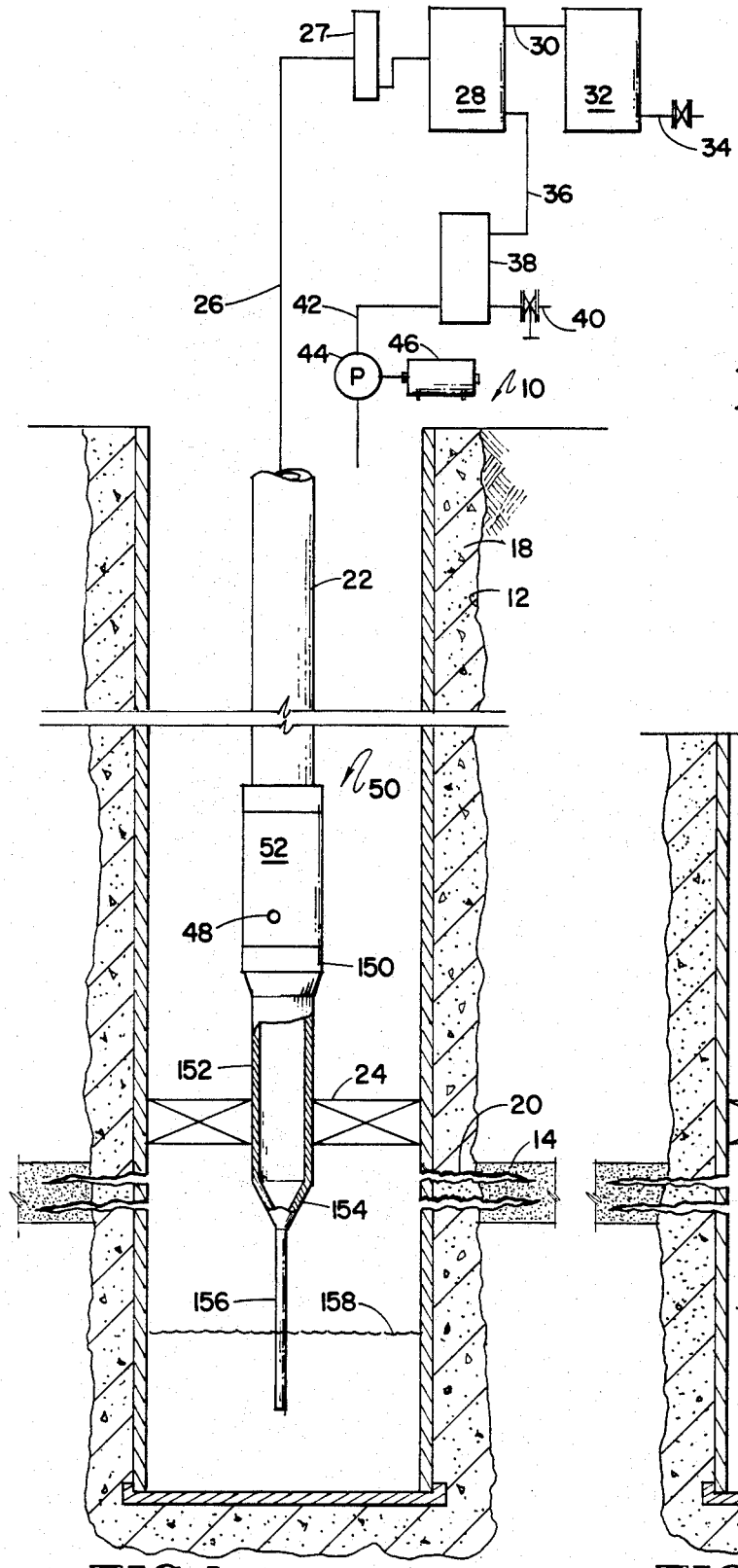
FIG. 1 is a cross-sectional view of a well equipped with the pumping mechanism of this invention.
Figure 2:
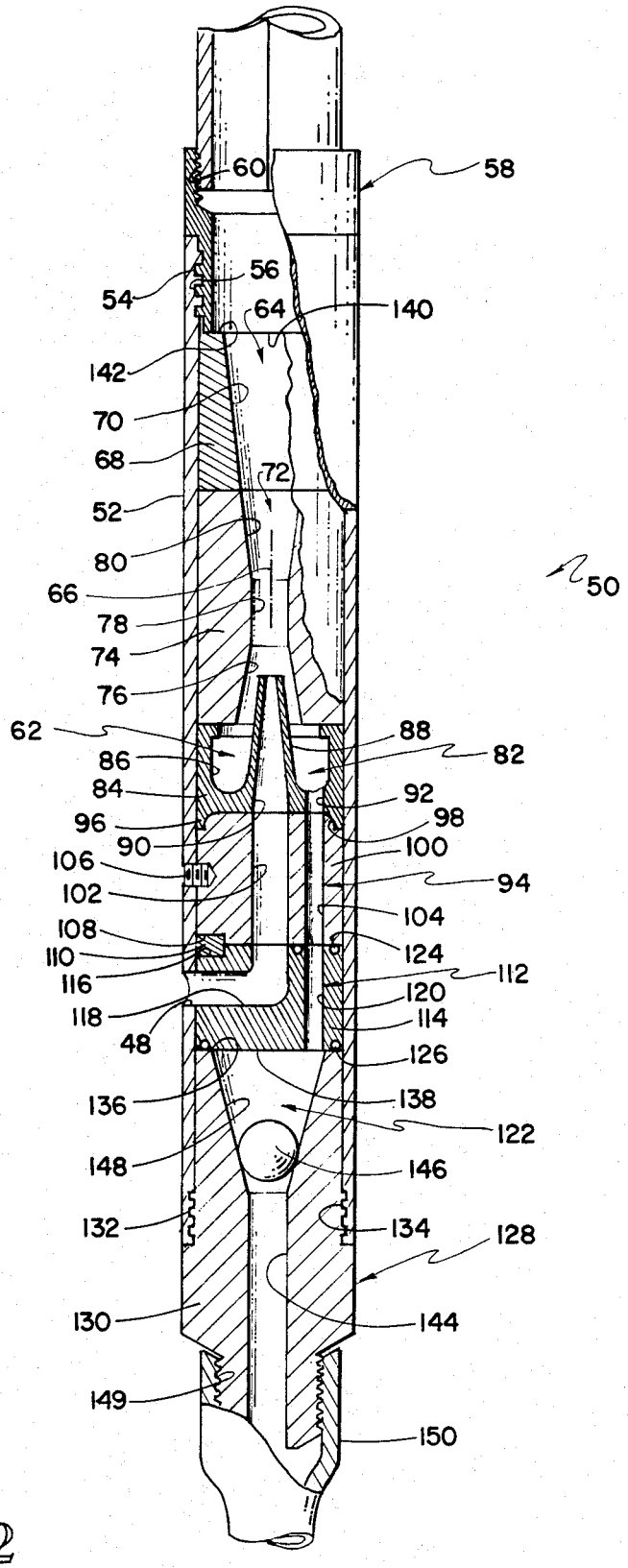
FIG. 2 is an enlarged cross-sectional view of a first embodiment of the pumping mechanism of this invention.

Referring to FIGS. 1 and 2, a well 10 comprises a bore hole 12 extending into the earth to a depth sufficient to penetrate an oil productive subterranean formation 14. A casing string 16 has been cemented in the bore hole 12 with a cement sheath 18 in a conventional manner. After the casing string 16 has been cemented, a conventional perforating gun (not shown) is used to provide a series of perforations 20 communicating between the formation 14 and the interior of the casing string 16.

A tubing string 22 is run into the well 10 and includes a packer 24 adjacent the lower end thereof. The tubing string 22 may include conventional API tubing joints having a pin on one end and a collar or the other. In the alternative, to produce a shallow oil productive formation, the tubing string 22 may comprise a conduit of organic polymeric material of considerable length. At present, polyethylene tubing is available in 500' spools and such material may comprise suitable tubing for shallow well installations using the technique of this invention.

At the surface, the tubing string 22 is suspended from a well head (not shown) and connects to a flow line 26 leading to a gas-liquid separator 27 in the event the well 10 makes a significant amount of gas and then to an oil-water separator 28, such as a conventional gun barrel. Inside the gun barrel 28, oil and water separate by gravity with oil overflowing through an outlet 30 to an oil storage tank or tanks 32 which is periodically run to sales through a valved outlet 34. It will accordingly be seen that any oil produced from the well 10 is accumulated in the tank 32 and sold therefrom.

Clean formation water is removed from the gun barrel 28 through a flow line 36 to an open top water tank 38 having a valved outlet 40 through which water can be drawn off when the tank 38 threatens to overflow. If the well 10 makes a significant amount of water, the tank 38 will ultimately fill up and some water will have to be trucked off or otherwise disposed of. If the well 10 does not make much water, evaporation off of the tank 38 will preclude rapid water buildup. Normally, water is drawn off the tank 38 through a flow line 42 to a pump 44 powered by a motor 46 through which it is injected into the annulus between the casing string 16 and tubing string 22 into the power fluid inlet 48 of a pump assembly 50 of this invention.

The pump assembly 50 comprises an elongate housing 52 slightly larger than standard API 2⅜" tubing having coarse female threads 54 on the upper end thereof engaged with complementary threads 56 provided by a coupling 58 threaded onto the lowermost pin 60 of the tubing string 22. Because of the different types of threads that might exist on the bottom of the tubing string 22, the coupling 58 acts as an adaptor to connect the housing 52 to the tubing string 22.

Inside the housing 52 are a series of generally cylindrical metallic sections which comprise a jet pump 62 of this invention. The uppermost section 64 is symmetrical about an axis 66 of the assembly 50 and comprises a body 68 and an internal passage 70 of frusto-conical shape diverging upwardly toward the tubing string 22. It will be seen that the uppermost section 64 provides a smooth transition surface between the next lower section 72 and the interior of the tubing string 22.

Below the transition section 64 is a throat-diffuser section 72 which is symmetrical about the axis 66 and comprises a body 74 having a passage therethrough of complex configuration. The passage provides an inlet diffuser surface 76 which is frusto-conical in shape and diverges downwardly, an intermediate throat section 78 of generally constant diameter and an outlet diffuser surface 80 which is frusto-conical in shape and diverges upwardly to merge smoothly with the passage 70 of the transition section 64.

Below the throat-diffuser section 72 is a nozzle section 82 which is asymmetrical about the axis 66 and comprises a body 84 of external cylindrical shape having an annular depression 86 surrounding an upwardly extending frusto-conical shaped nozzle 88 which projects above the top of the section 82 into the opening provided by the inlet diffuser surface 76. A central passage 90 extends through the nozzle section 82 and through the nozzle 88 to deliver power fluid through the jet pump 62 as will be more fully pointed out hereinafter. The nozzle 88 and depression 86 are conveniently symmetrical about the axis 66 with the asymmetry of the nozzle section 82 being provided by an offset suction inlet passage 92 providing communication between the interior of the jet pump 62 and the formation 14. As will be more fully apparent hereinafter, it is necessary to orient the nozzle section 82 relative to an underlying spacer section 94 to align the suction inlet passage 92 with a corresponding passage in the spacer section 94. This is readily accomplished by providing downwardly extending projections 96 on the nozzle section 82 and similar recesses 98 on the spacer section 94.

Below the nozzle section 82 is a spacer section 94 which is asymmetric relative to the axis 66 and includes a body 100 having a central power fluid passage 102 aligned with the passage 90 and an offset inlet passage 104 aligned with the suction inlet passage 92. A set screw 106 extends through the housing 52 into the body 100 to fix the angular position of the spacer section 94. It will be seen that the nozzle section 82 is oriented relative to the spacer section 94 by the projections 96 and recesses 98. A recess 108 is provided in the lower surface of the body 100 to receive a key 110 to orient the spacer section 94 relative to an underlying power fluid inlet section 112.

The power fluid inlet section 112 includes a cylindrical body 114 having a recess 116 in the upper surface thereof receiving part of the key 110 to orient the section 112 relative to the section 94. The section 112 also includes a central L-shaped passage 118 providing communication between the power fluid inlet opening 48 through the housing and the central power fluid passage 102 in the spacer section 94. An offset passage 120 provides communication between the offset inlet passage 104 and a check valve compartment 122 below the jet pump 62. Suitable O-ring grooves 124, 126 and O-rings (not shown) may be provided in the body 114 as desired.

Below the power fluid inlet section 112 is a formation inlet section or coupling 128 including a body 130 having coarse male threads 132 intermediate the ends thereof threadably receiving the lowermost coarse female threads 134 provided by the housing 52. The body 130 provides an upper horizontal surface 136 bearing against the underside 138 of the power fluid inlet section 112 and pushing the section 112 against the section 94 which is held is place by the set screw 106. The upper sections 64, 72, 82 are pushed downwardly against the section 94 by threadably advancing the coupling 58 relative to the housing 52 so that the lower surface 140 of the coupling 58 abuts the upper surface 142 of the upper section 64. Thus, the sections 64, 72, 82, 112 are merely captivated between the couplings 58, 128 and the section 94 which is rigid with the housing 52. It will accordingly be seen that the sections 64, 72, 82, 94, 112, and are not rigidly coupled together.

The section 128 includes a central passage 144 extending from the lower end of the section 128 to the check valve compartment 122 which is conveniently of upwardly diverging frusto-conical shape receiving a check valve ball 146 larger than the passage 144. It will thus be seen that the ball 146 seats on the frusto-conical surface 148 of the compartment 122. It will be appreciated that the passage 120 is offset and opens into the upper corner of the compartment 122 to preclude the possibility that the ball 146 would seat and seal the passage 120.

The lower end of the formation inlet section or coupling 128 includes fine threads 149, such as API 8 round, which may be directly received by a collar 150 of a pup joint 152 extending through the packer 24. At a location below the packer 24 and preferably near the bottom of the formation 14, a swedge or reducer 154 is used to neck down a small diameter tail pipe assembly 156 which extends substantially below the bottom of the formation 14. The tail pipe assembly 156 extends below the face of the formation 14 to allow the pump assembly 50 to withdraw formation liquids from the well bore with a minimum hydrostatic head applied to the formation 14.

Operation of the well 10 should now be apparent. To commence pumping of the well 10, a source of power fluid is needed. Thus, the water tank 38 may be partially filled with clean formation water from a nearby well and the water pumped into the annulus between the tubing string 22 and the casing string 16. The pumped water ultimately enters the power fluid inlet 48 and begins upwardly movement through the central power fluid passage 102 and the nozzle passage 90. Because of the action of the power fluid in the jet pump 62, formation liquid moves upwardly through the tail pipe assembly 156, pup joint 152, formation inlet section 128 and offset suction inlet passages 120, 104, 92 to adjacent the power fluid nozzle 88. In the throat-diffuser section 72, the power fluid and formation fluid mix and then travel up the tubing string 22 to the surface. At the surface, the mixture passes through a gas-liquid separator 27 if there is a substantial amount of gas produced along with the formation liquids. If there is no substantial amount of gas produced, the mixed liquids are delivered directly to the gun barrel separator 28 where oil and water are gravitationally separated. Ultimately, the gun barrel 28 fills up thereby allowing oil to overflow through the outlet 30 into the storage tank 32. Water is drawn off the bottom of the gun barrel in a conventional manner, using float controls (not shown) if necessary. One of the advantages of this invention is that operation of the pump assembly 50 may be either continuous to provide the maximum amount of formation liquid recovery may be controlled by a clock or other suitable mechanism for periodically operating the motor 46 and pump 44.

In order to allow the pump assembly 50 to withdraw formation liquid from substantially below the formation 14, it will be realized that the maximum theoretical vacuum which could be pulled by the jet pump 62 corresponds to about 33 feet of water. Although the density of the formation liquids delivered through the pump 50 will be less than that of water, they will not be substantially less. Thus, there is a theoretical and practical limit to how much the liquid level 158 can be lowered. In any event, it is desirable to position the pump assembly 50 as low as practicable. This means that the packer 24 should likewise be positioned as low as possible and that the mechanical components which space the bottom of the pump assembly 50 from the packer should be as short as possible.

Figure 3:
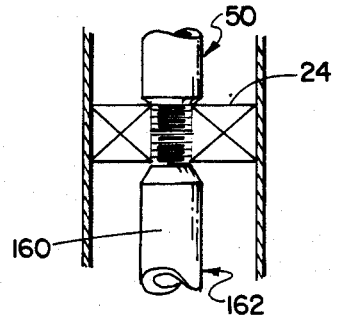
FIG. 3 is a cross-sectional view, similar to FIG. 1, of a well equipped with a modification of this invention.

To this end, it may be desired to attach the bottom threads 148 of the coupling 128 directly into the top of the packer 24 as shown in FIG. 3 with a stinger 160 threaded into the bottom of the packer 24 to provide a tail pipe assembly 162.

Figure 4:
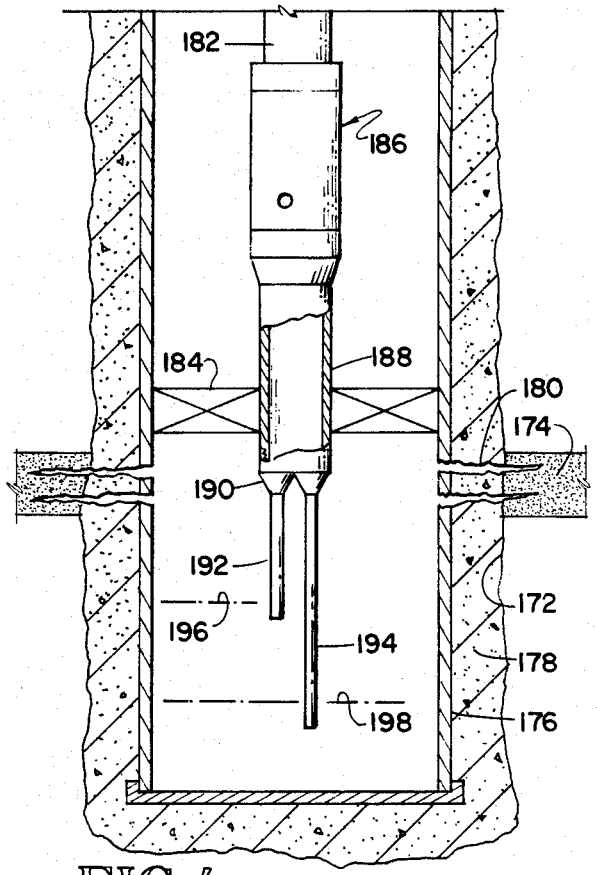
FIG. 4 is a cross-sectional view, similar to FIGS. 1 and 3, of a well equipped with a modification of this invention.

Referring to FIG. 4, a well 170 comprises a bore hole 172 extending into the earth to a depth sufficient to penetrate an oil producing formation 174. A casing string 176 has been cemented in the bore hole 172 with a cement sheath 178 in a conventional manner. A series of perforations 180 provide communication between the formation 174 and the interior of the casing string 176.

A tubing string 182 is run into the well 170 and includes a packer 184 adjacent the lower end thereof. The tubing string 182 may include conventional API tubing joints or elongate polymeric tubing, as desired. A pump assembly 186 substantially as shown in FIG. 2 is positioned at the bottom of the tubing string 182 immediately above the packer and connects to a pup joint 188 extending through the packer 184. A Y-connector 190 threads into the bottom of the pup joint 188 and a pair of smaller diameter tail pipe sections 192, 194 threadably attach to the connector 190. The tail pipe sections 192, 194 are of different length. The section 192 preferably extends below the bottom of the pump assembly a distance of about ten feet while the section 194 extends downwardly about another ten feet.

When pumping begins, formation liquid will travel upwardly through both tail pipes 192, 194 to reach the pump assembly 186. There will be more flow through the tail pipe 192 because this is the shortest and least path of resistance. In the event the fluid level in the well 170 is lowered below the formation 174 sufficiently to uncover the lower end of the tail pipe 192, liquid travel up the tail pipe 192 obviously ceases. Even though liquid travel in the tail pipe 192 may cease, there is still gas flow in this tail pipe which will cause a reduction of pressure in the well 170 below the packer 184, causing the creation of a partial vacuum opposite the face of the formation 174. This will, of course, promote fill in of formation liquids into the well bore and tend to cover up the bottom of the tail pipe 192 so that liquid again moves upwardly therethrough.

In the event the lower end of the tail pipe 192 is uncovered, all of the lifted liquid moves upwardly through the longer tail pipe section 194 thereby tending to maintain the liquid level below the bottom of the tail pipe 192. As mentioned previously, this tends to create a partial vacuum in the well bore promoting fluid entry from the formation 174. If the rate of fill in from the formation 174 is greater than can be lifted through the tail pipe 194, the liquid level in the bottom of the well 170 will rise until the lower end of the tail pipe 192 is again covered. When this occurs, the capacity of the pump assembly 186 increases because both tail pipes 192, 194 are in the fluid circuit. Thus, the liquid level in the well 170 likely oscillates between the level 196 where the capacity of the pump assembly 186 is greater than the fill in rate of the formation 174 and a lower level 198 where the fill in rate of the formation 174 exceeds the capacity of the pump assembly 186.

While the various embodiments of this invention have been described with a certain degree of particularity, it is understood that this description is only by way of example and that numerous changes in the details of operation and combination and arrangement of parts may be resorted to without departing from the spirit and scope of the invention as hereinafter claimed.

I claim:

1. A well equipped to produce oil from a subterranean formation including a casing string cemented in a well bore penetrating the earth to a depth below the formation and having a multiplicity of perforations therein providing communication between the formation and the casing string, a packer sealed against the interior of the casing string above the formation, a tubing string inside the casing string extending upwardly to the surface and connected to the packer, a jet pump in the tubing string adjacent the packer and a tail pipe assembly in communication adjacent the packer and a tail pipe assembly in communication with the tubing string providing a suction inlet to the jet pump, the tail pipe assembly extending below the packer and below the perforations and comprising first and second tail pipe sections having openings therein adjacent the lower ends thereof, the first and second tail pipe sections extending to different depths in the well adjacent the formation.

2. The well of claim 1 wherein the first and second tail pipe sections both extend below the lowermost perforation.

3. The well of claim 2 wherein the first tail pipe section extends about ten feet below the packer and the second tail pipe section extends about twenty feet below the packer.

4. A downhole jet pump assembly comprising an elongate generally cylindrical housing having a longitudinal axis, threaded upper and lower ends and a power fluid inlet opening laterally thereinto intermediate the upper and lower ends;

an upper coupling threaded onto the upper housing end and having a shoulder thereon;

an uppermost cylindrical transition section, slidably received in the housing, symmetrical about the axis having a body in engagement with the shoulder of the upper coupling and a central passage divergent toward the upper coupling;

a cylindrical throat-diffuser section, unconnected to the transition section and separately slidably received in the housing, symmetrical about the axis and having a body abutting the transition section providing a central passage including a lowermost upwardly converging section, an intermediate throat of generally constant cross section and an uppermost upwardly diverging section, the upwardly diverging section and the central passage of the transition section providing a smooth passage;

a cylindrical nozzle section, unconnected to the transition section and separately slidably received in the housing, asymmetrical about the axis and having a body abutting the throat-diffuser section providing a central nozzle received in the lowermost upwardly converging section of the throat-diffuser section, the body providing a first central power fluid passage extending through the nozzle and a first suction inlet passage offset relative to the axis;

a cylindrical spacer section, unconnected to the nozzle section and separately received in the housing, asymmetrical about the axis and having a body abutting the nozzle section providing a second central power fluid passage in communication with the first power fluid passage and a second suction inlet passage in communication with the first suction inlet passage;

a cylindrical power fluid inlet section, unconnected to the spacer section and separately slidably received in the housing, asymmetrical about the axis and having a body providing a generally L-shaped power fluid passage providing communication between the power fluid inlet opening in the housing and the second power fluid passage and a third suction inlet passage in communication with the second suction inlet passage;

means rigidly connecting one of the asymmetrical sections to the housing;

means cooperative between the rigidly connected asymmetrical section and the other asymmetrical sections for radially orienting the other asymmetrical sections relative to the rigidly connected asymmetrical sections for aligning the first, second and third suction inlet passages; and a lower coupling threaded onto the lower housing end having a shoulder abutting and forcing the power fluid inlet section into engagement with the spacer section;

the upper coupling being threaded onto the housing and arranged to force the transition section, the throat-diffuser section and the nozzle section against the spacer section.

5. The jet pump of claim 4 wherein the lower coupling includes a central formation fluid inlet passage having a check valve therein.

6. The jet pump of claim 5 wherein the formation fluid inlet passage comprises an inlet section of generally uniform diameter and a chamber of upwardly diverging cross-section symmetrical about the axis, and the check valve comprises a ball valve in the chamber, the third suction inlet passage opening into the chamber at a location offset relative to the axis.

7. The jet pump of claim 4 wherein the rigidly connecting means comprises a fastener securing the spacer section to the housing and the cooperative means comprises a projection extending between the nozzle section and the spacer section for radially orienting the nozzle and spacer sections to align the first and second suction inlet passages and a projection extending between the spacer section and the power fluid inlet section for radially orienting the spacer and power fluid inlet sections to align the second and third suction inlet passages.

* * * * *